US006050169A

United States Patent [19]

Voros

[11] Patent Number: 6,050,169

[45] Date of Patent: Apr. 18, 2000

[54] DIE SYSTEM FOR RESIZING THE NECK OF A FIRED CARTRIDGE

[76] Inventor: Kenneth R. Voros, 14609 Oceana, Allen Park, Mich. 48101

[21] Appl. No.: 08/986,345

[22] Filed: Dec. 8, 1997

[51] Int. Cl.[7] ..... F24B 33/10

[52] U.S. Cl. ..... 86/24; 86/32; 86/37; 86/43

[58] Field of Search ..... 86/1.1, 23–28, 86/32, 36–38, 43, 44; 102/430, 464, 465, 468; 29/1.3, 1.31, 1.32

[56] References Cited

U.S. PATENT DOCUMENTS

| | | | |
|---|---|---|---|
| 185,548 | 12/1876 | Kinney | 102/464 |
| 1,103,203 | 7/1914 | Hoagland | 102/464 |
| 2,133,198 | 10/1938 | Jayne | 86/37 |
| 3,283,643 | 11/1966 | Mittelsteadt | 86/36 |
| 4,189,980 | 2/1980 | Schaenzer | 86/37 |
| 4,675,958 | 6/1987 | Rosenbaum et al. | 86/37 |
| 4,723,472 | 2/1988 | Lee | 86/37 |
| 5,635,661 | 6/1997 | Tuftee | 86/37 |

FOREIGN PATENT DOCUMENTS

| | | | |
|---|---|---|---|
| 24289 | 1/1895 | United Kingdom | 102/430 |
| 16107 | 5/1899 | United Kingdom | 102/464 |

*Primary Examiner*—Harold Tudor
*Attorney, Agent, or Firm*—Charles W. Chandler

[57] ABSTRACT

A fired rifle cartridge is resized in the cartridge neck area for reuse. A first die set is employed to compress the cartridge neck such that the inner surface of the neck fits a standard size bullet. A second die set is used to expand selected areas of the cartridge neck to snugly fit the firing chamber. The resultant ammunition round can be fired with a greater degree of accuracy than ammunition resized by prior art procedures, because the longitudinal axis of the cartridge neck coincides with the bore axis of the firearm.

8 Claims, 2 Drawing Sheets

DIE SYSTEM FOR RESIZING THE NECK OF A FIRED CARTRIDGE

BACKGROUND AND SUMMARY OF THE INVENTION

This invention relates to an apparatus for reforming the neck of a metal cartridge case so that it will properly seat in the firing chamber of a firearm, with the axis of the bullet aligned with the axis of the barrel.

Marksmen commonly hand load their metallic cartridge cases in order to increase the accuracy of their firearms over and above that obtainable from using commercially available ammunition.

The cartridge case has to be resized because the explosive force generated by the propellant during the firing process expands the cartridge neck to the dimension of the chamber in which it is fired. When the cartridge case is to be reused, the neck is oversized and usually is squeezed down to a smaller diameter so that it will fit into the chamber. Consequently a gap exists between the chamber and the assembled ammunition which varies according to the chamber dimension tolerances, the bullet dimension tolerances and the case dimension tolerances. The stack-up of tolerances can total 0.020 inches in a brand new 308 Winchester, even more in a well worn or shot out barrel. The loose fit produces a firing inaccuracy because the bullet axis does not align with the bore axis.

SUMMARY OF THE INVENTION

The broad purpose of the present invention is to permit a hand loader to assemble ammunition for a specific firearm with no gap between the ammunition and the chamber, with no danger of increasing pressure, while maintaining the ease of chambering.

The invention is particularly applicable to reforming cartridge cases used in firearms chambered for military calibers such as 3006, 308 Winchester; 7.62 NATO; 45 ACP; 9 MM Luger, etc.

The preferred apparatus reforms a cartridge case such that the neck area has two outside diameters. In the preferred embodiment of the invention, the neck is squeezed into a cylindrical configuration.

Then the neck is expanded by a expander button available with current reloading die sets so that the inside diameter accommodates the diameter of the bullet. A faceted expander button is then pushed into the neck to form longitudinal ridges so that selected areas of the outside surface of the neck are expanded to closely fit in the firing chamber.

The same result can be achieved with a collet type die by either grooving or dimpling the neck area of the die to a depth of approximately 0.015 inches. The neck is then squeezed to form a cylinder having raised areas that snugly fit in the firing chamber. The reformed cartridge case produces a more consistent firing pattern for a specific firearm than a reloaded case using the same components without the dual diameter neck.

Still further objects and advantages of the invention will become readily apparent to those skilled in the art to which the invention pertains upon reference to the following detailed description.

DESCRIPTION OF THE DRAWINGS

The description refers to the accompanying drawings in which like reference characters refer to like parts throughout the several views, and in which.

DESCRIPTION OF THE PREFERRED EMBODIMENT

Figure 1:
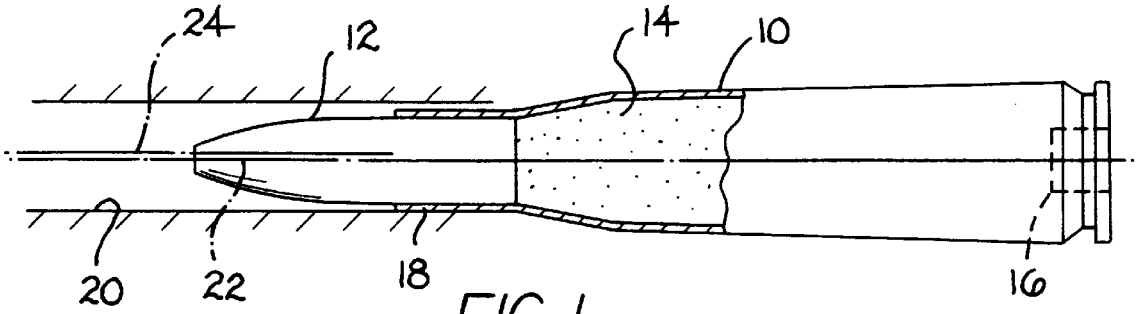
FIG. 1 illustrates a partially sectional view of a cartridge in a firing chamber to illustrate the misalignment of a prior art reformed cartridge.

Referring to the drawings, FIG. 1 shows a metallic rifle round that has been reconditioned in accordance with the prior art practice. The round comprises a brass cartridge 10, a bullet 12 and a propellant 14. The cartridge has a thickened base with a cavity containing a percussion primer 16. The open end of the cartridge has a cylindrical neck 18. When a round is fired, the bullet is released from the cartridge for travel through rifle barrel 20.

The problem is that the longitudinal axis 22 of the cartridge is slightly misaligned from the axis 24 of the rifle bore 24 because of the stack-up of tolerances between the various cartridge components. The misalignment has been somewhat exaggerated, however, it is normally sufficient to significantly affect the accuracy of a bullet fired from the firearm. The object of the invention is to form the cartridge neck so neck axis 22 coincides with bore axis 24.

Figure 7:
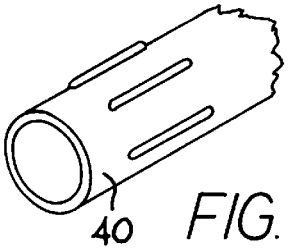
FIG. 7 is a fragmentary view illustrating the final configuration of the neck.
Figure 9:
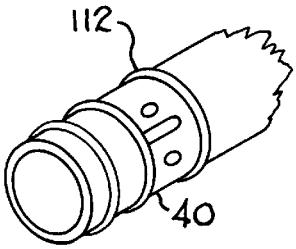
FIG. 9 is a fragmentary view illustrating the configuration of the neck after the FIG. 8 process.

The preferred cartridge has a neck formed with two diameters. Examples are illustrated in FIGS. 7 and 9 which show two forms the neck can take, other forms are possible.

Figure 2:
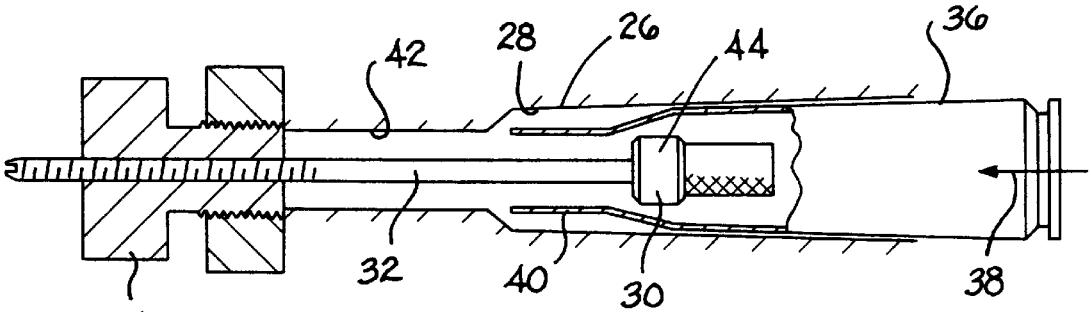
FIG. 2 is an enlarged view illustrating a previously fired cartridge case being inserted in a die chamber in order to reduce the neck diameter, prior to a die button being withdrawn through the neck to form the final internal diameter.

Referring to FIG. 2, a conventional spent die case 26 is used. Case 26 has an internal chamber 28. A metal die button 30, mounted on the end of a rod 32, is inserted into chamber 28. The precise location of the die button is adjusted by means of a threaded adjusting member 34 in the usual manner.

Figure 3:
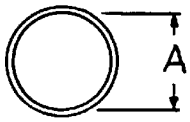
FIG. 3 illustrates the cylindrical configuration of the neck after the steps illustrated in FIG. 2.

A spent metal cartridge 36 is inserted into chamber 28 by a suitable press, not shown, which drives the shell in the direction of arrow 38. At this stage of the process the diameter of the cartridge neck 40 is oversized. The neck is pressed into a cylindrical die section 42, and squeezed to an undersized diameter. The cartridge is then pulled in the direction opposite to arrow 38. At this point the inner diameter of the neck is smaller than the diameter of the cylindrical forming portion 44 of the die button so that as the neck is withdrawn it is enlarged to a diameter A, see FIG. 3, which accommodates the diameter of the bullet.

The die button and rod 32 are then removed and the die button replaced with another die button 45 having a hexagonal cross section. The outside corners such as at 46 of die button 45 have a diameter greater than the internal diameter of the neck as it is initially extracted from die chamber 28.

Figure 5:
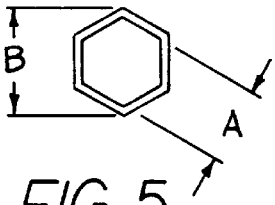
FIG. 5 illustrates the configuration of the neck after the outer surface has been enlarged to a diameter accommodating the firing chamber.
Figure 4:
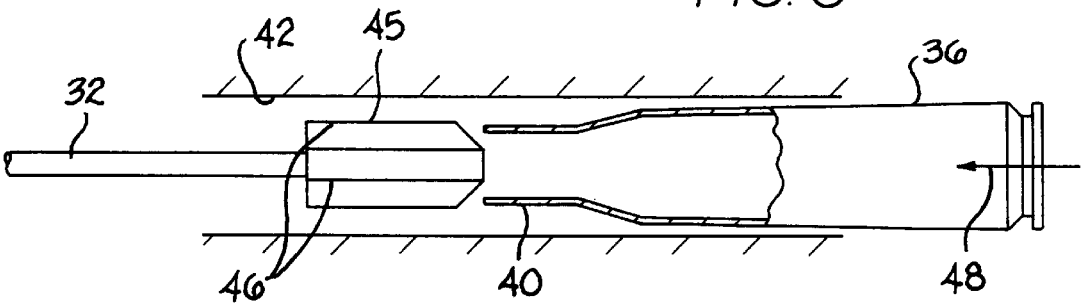
FIG. 4 illustrates a faceted die button being inserted into the neck to enlarge selected portions of the outer neck surface.

Referring to FIG. 4, the cartridge is then inserted in the die chamber in the direction of arrow 48 and moved back and forth on die button 45 to enlarge selected portions of the neck. The outer surface of the neck is enlarged along a major portion of its length. The cartridge is then removed at which point it has a neck cross-section generally as illustrated in FIG. 5 in which inner diameter A accommodates the diameter of the bullet, and outside diameter B provides a snug fit with the bore of a specific firearm.

Typically a kit will be sold to the hand loader containing, for example, three different diameter hexagonal die buttons so that the hand loader can locate a die button that will accommodate a specific firearm. For example, a set of three die buttons may have a diameters of 0.312 inches, 0.316 inches, and 0.320 inches.

Figure 6:
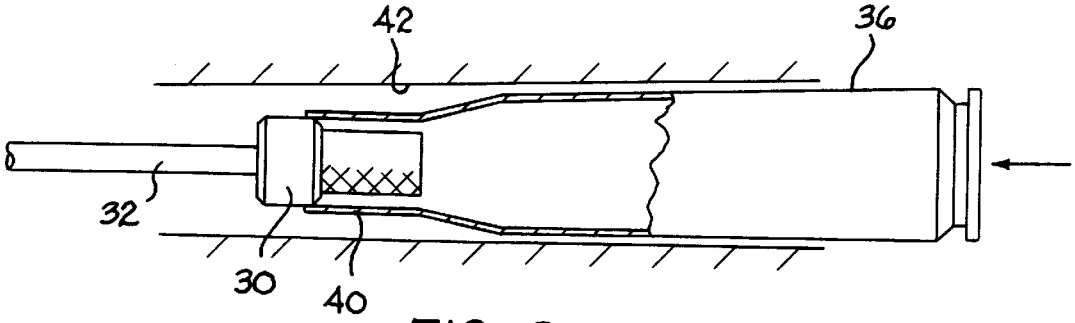
FIG. 6 illustrates the final step by forming the open end of the neck with a cylindrical configuration in order to properly seal the bullet.

Referring to FIG. 6, the next step is to reinsert the original die button in the die chamber such that cylindrical forming section 44 reforms the outer end of the neck, about a 1/16 inch to a cylindrical shape. This re-shaped end will seal the internal gasses within the body of the cartridge. The finished neck generally takes the configuration of FIG. 7. The hand loader then completes the reloading process by inserting primer 16, powder 14, and finally bullet 12.

Figure 8:
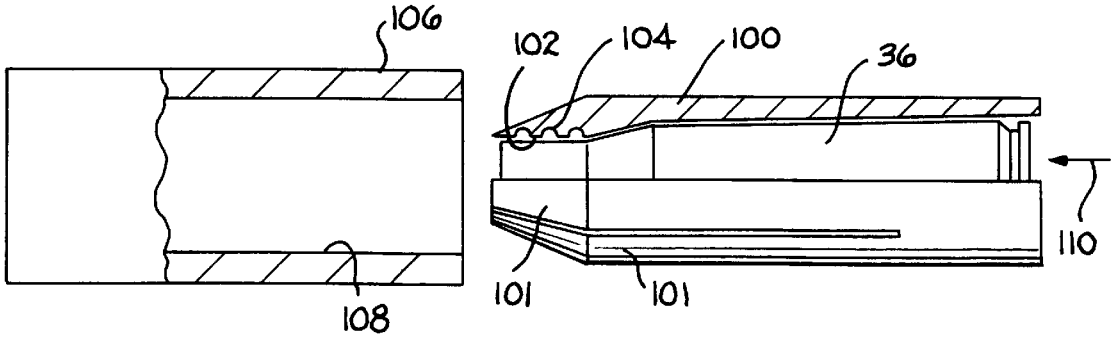
FIG. 8 shows a fragmentary sectional view of a collet type of apparatus for reforming the neck.
Figure 10:
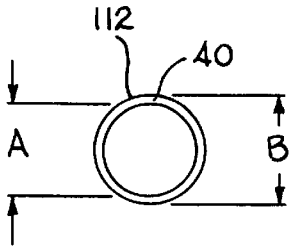
FIG. 10 illustrates the two diameters of the neck of the FIG. 9 configuration.

FIGS. 8 to 10 illustrate another apparatus and method for reforming the neck of the spent firing cartridge 36. Cartridge 36 is inserted in a split collet 100. The collet has radially compressible fingers 101 and an internal cylindrical forming section 102 with a pattern of grooves 104 for forming the cartridge neck. The collet and the previously fired cartridge are inserted in a case 106 having a cylindrical chamber 108, in the direction of arrow 110. As the collet is inserted in chamber 108, the radially compressible fingers squeeze the die neck until the inside neck diameter corresponds to diameter A which accommodates the diameter of the bullet. The pattern of grooves 104 forms an external pattern of ridges 112 on neck 40, as illustrated in FIG. 9. The outside diameter of the ridges is formed with diameter B which accommodates the diameter of the rifle bore. Thus, the finished neck has two custom final diameters, an inside diameter which accommodates a specific bullet, and an outer diameter which accommodates the diameter of a specific firing chamber.

Other configurations and other apparatus can be used to form the outer protuberance such as dimples and the like to provide the outside surface configuration.

Having described my invention, I claim:

1. A die system for resizing a neck of a fired cartridge, having a longitudinal axis, an inner cylindrical surface and an outer cylindrical surface, said die system comprising:

a first die set operable to resize the inner cylindrical surface of the cartridge neck, to accommodate a diameter of a bullet; and a second die set operable to enlarge selected areas of the outer surface of the cartridge neck to form a close fit with a firing chamber of a firearm, whereby the cartridge longitudinal axis is aligned with a barrel axis of a firearm when the cartridge is disposed in the firing chamber of the firearm.

2. The die system for resizing a neck of the fired cartridge as defined in claim 1, in which the second die set is operable to enlarge selected areas of the outer surface of the cartridge neck to form a hexagonal cross section.

3. A method for reforming a neck of a fired cartridge shell comprising:

squeezing a neck diameter so that an internal diameter of the neck accommodates a diameter of a bullet; and enlarging selected portions of the neck to an outside diameter that accommodates a diameter of a firing chamber.

4. The method as defined in claim 3, in which a cartridge shell has an open end and including the step of resizing the open end of the cartridge shell so that it has a cylindrical configuration accommodating the diameter of the bullet to seal the gasses in the cartridge shell as it is being fired.

5. The method as defined in claim 3, in which the neck is initially squeezed to a diameter where it can be seated in a firearm firing chamber, and then longitudinally expanding selected portions of the neck so that the inner surfaces of the neck accommodate the diameter of the bullet, and selected portions of an outer surface of the neck form a snug fit in the firing chamber.

6. The method as defined in claim 3, in which the cartridge shell is inserted in a compressible collet having an internal enlargement, and including the step of inserting the cartridge shell and the collet in a chamber to deform the neck so that the neck has an inner diameter accommodating the diameter of the bullet, and an outer enlargement accommodating the diameter of the firing chamber.

7. The method as defined in claim 3, including the step of enlarging selected portions of the neck to form a hexagonal cross section.

8. A die system for resizing a neck of a fired cartridge having a longitudinal axis, an inner surface and an outer surface, comprising:

a collet having compressible fingers and an internal bore for receiving the cartridge within said fingers;

the fingers having a surface pattern engageable with the neck of the cartridge; and means having an opening for receiving the cartridge and the collet so the fingers squeeze the neck of the cartridge such that the inner surface of the neck has a diameter for receiving a bullet, and the outer surface of the neck has protuberances that closely fit a firing chamber of a specific firearm.

* * * * *